US010262665B2

(12) United States Patent
Seo et al.

(10) Patent No.: US 10,262,665 B2
(45) Date of Patent: Apr. 16, 2019

(54) METHOD AND APPARATUS FOR PROCESSING AUDIO SIGNALS USING AMBISONIC SIGNALS

(71) Applicant: Gaudio Lab, Inc., Los Angeles, CA (US)

(72) Inventors: Jeonghun Seo, Seoul (KR); Hyunoh Oh, Seongnam-si (KR); Sangbae Chon, Seoul (KR); Taegyu Lee, Seoul (KR); Sewoon Jeon, Daejeon (KR); Yonghyun Baek, Seoul (KR); Cheolwoo Jeong, Seoul (KR)

(73) Assignee: Gaudio Lab, Inc., Los Angeles, CA (US)

( * ) Notice: Subject to any disclaimer, the term of this patent is extended or adjusted under 35 U.S.C. 154(b) by 0 days.

(21) Appl. No.: 15/691,682

(22) Filed: Aug. 30, 2017

(65) Prior Publication Data

US 2018/0068664 A1 Mar. 8, 2018

(30) Foreign Application Priority Data

Aug. 30, 2016 (KR) ..... 10-2016-0111104
Oct. 31, 2016 (KR) ..... 10-2016-0143455

(51) Int. Cl.

| | |
|---|---|
| ***H04S 3/00*** | (2006.01) |
| ***H04S 7/00*** | (2006.01) |
| ***G10L 19/008*** | (2013.01) |

(52) U.S. Cl.
CPC ..... *G10L 19/008* (2013.01); *H04S 3/008* (2013.01); *H04S 7/302* (2013.01); *H04S 2400/11* (2013.01); *H04S 2420/11* (2013.01)

(58) Field of Classification Search
None
See application file for complete search history.

(56) References Cited

U.S. PATENT DOCUMENTS

| | | | | |
|---|---|---|---|---|
| 5,757,727 | A * | 5/1998 | Hanafy | B06B 1/0629 29/25.35 |
| 2015/0350804 | A1* | 12/2015 | Crockett | H04R 5/02 381/307 |
| 2016/0064005 | A1* | 3/2016 | Peters | H04S 3/008 381/23 |
| 2016/0198280 | A1* | 7/2016 | Schneider | H04S 7/40 381/17 |
| 2017/0188175 | A1* | 6/2017 | Oh | H04S 7/307 |
| 2017/0251323 | A1* | 8/2017 | Jo | H04S 5/00 |

* cited by examiner

*Primary Examiner* — Joshua Kaufman
*Assistant Examiner* — Kenny H Truong
(74) *Attorney, Agent, or Firm* — Park, Kim & Suh, LLC

(57) ABSTRACT

Disclosed is an audio signal processing device. The audio signal processing device includes a receiving unit configured to receive an ambisonic signal and an object signal, a processor configured to modify a magnitude of a specific directional component of the ambisonic signal based on a location of an object simulated by the object signal, and render a signal generated based on the object signal and the ambisonic signal having a magnitude-modified specific directional component, and an output unit configured to output the rendered signal.

17 Claims, 9 Drawing Sheets

METHOD AND APPARATUS FOR PROCESSING AUDIO SIGNALS USING AMBISONIC SIGNALS

CROSS-REFERENCE TO RELATED APPLICATION

This application claims priority to Korean Patent Application Nos. 10-2016-0111104 filed on Aug. 30, 2016 and 10-2016-0143455 field on Oct. 31, 2016, and all the benefits accruing therefrom under 35 U.S.C. § 119, the contents of which are incorporated by reference in their entirety.

BACKGROUND

The present invention relates to an audio signal processing method and device. More specifically, the present invention relates to an audio signal processing method and device for processing an audio signal expressible as an ambisonic signal.

3D audio commonly refers to a series of signal processing, transmission, encoding, and playback techniques for providing a sound which gives a sense of presence in a three-dimensional space by providing an additional axis corresponding to a height direction to a sound scene on a horizontal plane (2D) provided by conventional surround audio. In particular, 3D audio requires a rendering technique for forming a sound image at a virtual position where a speaker does not exist even if a larger number of speakers or a smaller number of speakers than that for a conventional technique are used.

3D audio is expected to become an audio solution to an ultra high definition TV (UHDTV), and is expected to be applied to various fields of theater sound, personal 3D TV, tablet, wireless communication terminal, and cloud game in addition to sound in a vehicle evolving into a high-quality infotainment space.

Meanwhile, a sound source provided to the 3D audio may include a channel-based signal and an object-based signal. Furthermore, the sound source may be a mixture type of the channel-based signal and the object-based signal, and, through this configuration, a new type of listening experience may be provided to a user.

An ambisonic signal may be used to provide a scene-based immersive sound. In particular, an higher order ambisonics (HoA) signal may be used to give a vivid sense of presence. In the case where the HoA signal is used, a sound acquisition procedure is simplified. Furthermore, in the case where the HoA signal is used, an audio scene of an entire three-dimensional space may be efficiently reproduced. Accordingly, an HoA signal processing technology may be useful for virtual reality (VR) for which a sound that gives a sense of presence is important. However, according to the HoA signal processing technology, it is difficult to accurately represent a location of an individual sound object within an audio scene.

SUMMARY

Embodiments of the present invention provide an audio signal processing method and device for processing a plurality of audio signals.

More specifically, embodiments of the present invention provide an audio signal processing method and device for processing an audio signal expressible as an ambisonic signal.

In accordance with an exemplary embodiment of the present invention, an audio signal processing device includes: a receiving unit configured to receive an ambisonic signal and an object signal; a processor configured to modify a magnitude of a specific directional component of the ambisonic signal based on a location of an object simulated by the object signal, and render a signal generated based on the object signal and the ambisonic signal having a magnitude-modified specific directional component; and an output unit configured to output the rendered signal.

The object signal and the ambisonic signal may be signals respectively obtained by converting an object sound and an ambient sound collected in the same space.

The processor may modify the magnitude of the specific directional component of the ambisonic signal based on a location vector generated when converting the object signal into an ambisonic signal format.

The processor may modify the magnitude of the specific directional component of the ambisonic signal based on a matching visual object matched to an object corresponding to the object signal.

The processor may determine, as the matching visual object, a visual object, a location of which varies with a change of the object corresponding to the object signal.

The processor may determine, as the matching visual object, a visual object, a visual feature of which varies with a change of a sound feature of the object corresponding to the object signal.

The processor may compensate the ambisonic signal having the magnitude-modified specific directional component by using an equalizer generated based on a frequency characteristic of the ambisonic signal.

The processor may reduce the magnitude of the specific directional component of the ambisonic signal based on the location of the object simulated by the object signal.

The processor may temporally synchronize the ambisonic signal with the object signal.

The processor may temporally synchronize the ambisonic signal with the object signal based on a time point at which a cross-correlation between the ambisonic signal and the object signal is maximized.

The processor may temporally synchronize the ambisonic signal with the object signal based on a time point at which a cross-correlation between a 0th order component of the ambisonic signal and the object signal is maximized.

The processor may temporally synchronize the ambisonic signal with the object signal by applying a delay to at least one of the ambisonic signal or the object signal.

In accordance with another exemplary embodiment of the present invention, a method for operating an audio signal processing device includes: receiving an ambisonic signal and an object signal; modifying a magnitude of a specific directional component of the ambisonic signal based on a location of an object simulated by the object signal; and rendering a signal generated based on the object signal and the ambisonic signal having a magnitude-modified specific directional component.

The object signal and the ambisonic signal may be signals respectively obtained by converting an object sound and an ambient sound collected in the same space.

The modifying the magnitude of the specific directional component of the ambisonic signal may include modifying the magnitude of the specific directional component of the ambisonic signal based on a location vector generated when converting the object signal into an ambisonic signal format.

The modifying the magnitude of the specific directional component of the ambisonic signal may include modifying the magnitude of the specific directional component of the ambisonic signal based on a location of a matching visual object matched to an object corresponding to the object signal.

The modifying the magnitude of the specific directional component of the ambisonic signal based on the location of the matching visual object may include determining, as the matching visual object, a visual object, a location of which varies with a modification of the object corresponding to the object signal.

The modifying the magnitude of the specific directional component of the ambisonic signal based on the location of the matching visual object may include determining, as the matching visual object, a visual object, a visual feature of which varies with a modification of a sound feature of the object corresponding to the object signal.

The modifying the magnitude of the specific directional component of the ambisonic signal may include compensating the ambisonic signal having the magnitude-modified specific directional component by using an equalizer generated based on a frequency response pattern of the ambisonic signal.

The modifying the magnitude of the specific directional component of the ambisonic signal may include reducing the magnitude of the specific directional component of the ambisonic signal based on the location of the object simulated by the object signal.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Figure 1:
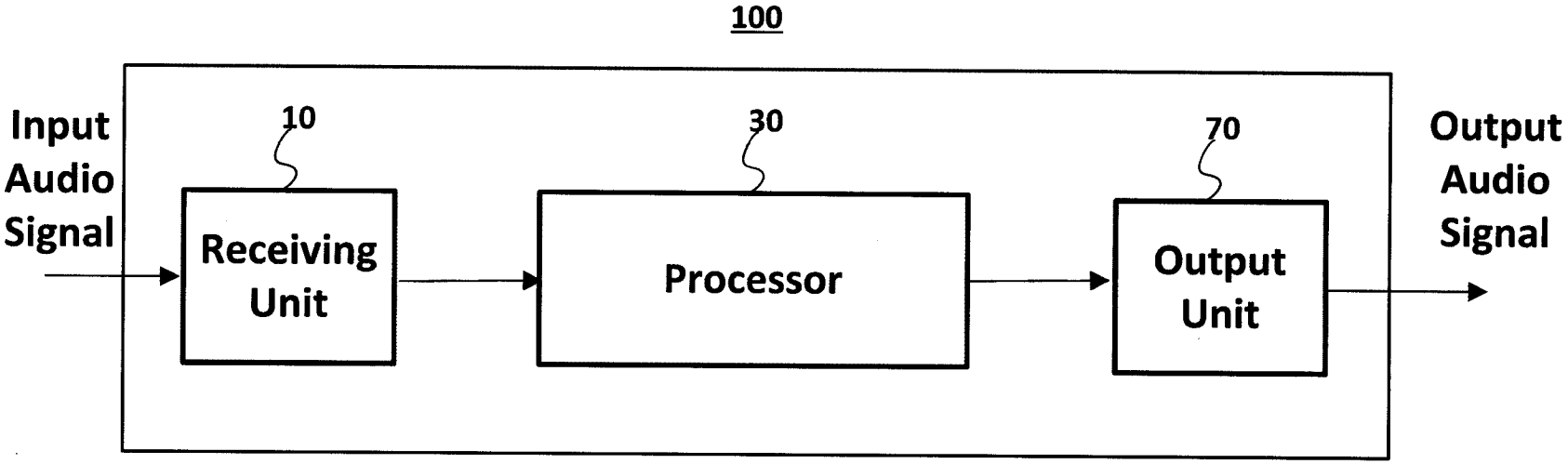
FIG. 1 is a block diagram illustrating an audio signal processing device according to an embodiment of the present invention.

Hereinafter, embodiments of the present invention will be described in detail with reference to the accompanying drawings so that the embodiments of the present invention can be easily carried out by those skilled in the art. However, the present invention may be implemented in various different forms and is not limited to the embodiments described herein. Some parts of the embodiments, which are not related to the description, are not illustrated in the drawings in order to clearly describe the embodiments of the present invention. Like reference numerals refer to like elements throughout the description.

When it is mentioned that a certain part "includes" certain elements, the part may further include other elements, unless otherwise specified.

The audio signal processing device according to an embodiment of the present invention includes a receiving unit 10, a processor 30, and an output unit 70.

The receiving unit 10 receives an input audio signal. Here, the input audio signal may be a signal obtained by converting a sound collected by a sound collecting device. The sound collecting device may be a microphone. The sound collecting device may be a microphone array including a plurality of microphones.

The processor 30 processes the input audio signal received by the receiving unit 10. In detail, the processor 30 may include a format converter, a renderer, and a post-processing unit. The format converter converts a format of the input audio signal into another format. In detail, the format converter may convert an object signal into an ambisonic signal. Here, the ambisonic signal may be a signal recorded through a microphone array. Furthermore, the ambisonic signal may be a signal obtained by converting a signal recorded through a microphone array into a coefficient for a base of spherical harmonics. Furthermore, the format converter may convert the ambisonic signal into the object signal. In detail, the format converter may change an order of the ambisonic signal. For example, the format converter may convert a higher order ambisonics (HoA) signal into a first order ambisonics (FoA) signal. Furthermore, the format converter may obtain location information related to the input audio signal, and may convert the format of the input audio signal based on the obtained location information. Here, the location information may be information about a microphone array which has collected a sound corresponding to an audio signal. In detail, the information on the microphone array may include at least one of arrangement information, number information, location information, frequency characteristic information, or beam pattern information of microphones constituting the microphone array. Furthermore, the location information related to the input audio signal may include information indicating a location of a sound source.

The renderer renders the input audio signal. In detail, the renderer may render a format-converted input audio signal. Here, the input audio signal may include at least one of a loudspeaker channel signal, an object signal, or an ambisonic signal. In a specific embodiment, the renderer may render, by using information indicated by an audio signal format, the input audio signal into an audio signal that enables the input audio signal to be represented by a virtual sound object located in a three-dimensional space. For example, the renderer may render the input audio signal in association with a plurality of speakers. Furthermore, the renderer may binaurally render the input audio signal.

Furthermore, the renderer may include a time synchronizer which synchronizes times of an object signal and an ambisonic signal.

Furthermore, the renderer may include a 6-degrees-of-freedom (6DOF) controller which controls the 6DOF of an ambisonic signal. The 6DOF controller may include a direction modification unit which modifies a magnitude of a specific directional component of an ambisonic signal. In detail, the 6DOF controller may modify the magnitude of a specific directional component of an ambisonic signal according to the location of a listener in a virtual space simulated by an audio signal. The direction modification unit may include a directional modification matrix generator which generates a matrix for modifying the magnitude of a specific directional component of an ambisonic signal. Furthermore, the 6DOF controller may include a conversion unit which converts an ambisonic signal into a channel signal, and may include a relative position calculation unit which calculates a relative position between a listener of an audio signal and a virtual speaker corresponding to a channel signal.

Furthermore, the direction modification unit may modify the magnitude of a specific directional component of an ambisonic signal according to a location of an object corresponding to an object signal rendered together with an ambisonic signal.

The output unit 70 outputs a rendered audio signal. In detail, the output unit 70 may output an audio signal through at least two loudspeakers. In another specific embodiment, the output unit 70 may output an audio signal through a 2-channel stereo headphone.

The audio signal processing device may concurrently process an ambisonic signal and an object signal. Specific operation of the audio signal processing device will be described with reference to FIG. 2.

Figure 2:
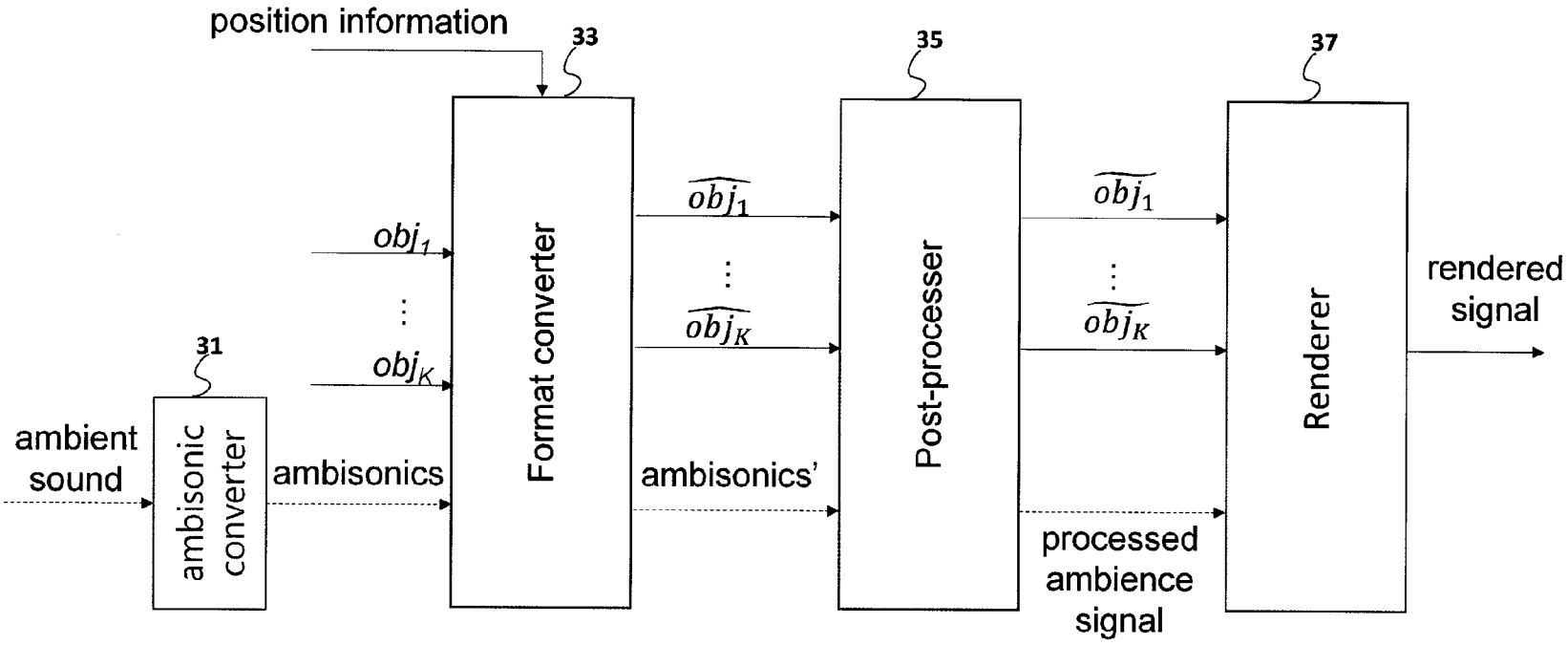
FIG. 2 is a block diagram illustrating that the audio signal processing device according to an embodiment of the present invention concurrently processes an ambisonic signal and an object signal.

FIG. 2 is a block diagram illustrating that the audio signal processing device according to an embodiment of the present invention concurrently processes an ambisonic signal and an object signal.

The above-mentioned ambisonics is one of methods for enabling the audio signal processing device to obtain information on a sound field and reproduce a sound by using the obtained information. In detail, the ambisonics may represent that the audio signal processing device processes an audio signal as below.

For ideal processing of an ambisonic signal, the audio signal processing device is required to obtain information on a sound source from sounds from all directions which are incident to one point in a space. However, since there is a limit in reducing a size of a microphone, the audio signal processing device may obtain the information on the sound source by calculating a signal incident to an infinitely small dot from a sound collected from a spherical surface, and may use the obtained information. In detail, in a spherical coordinate system, a location of each microphone of the microphone array may be represented by a distance from a center of the coordinate system, an azimuth (or horizontal angle), and an elevation angle (or vertical angle). The audio signal processing device may obtain a base of spherical harmonics using a coordinate value of each microphone in the spherical coordinate system. Here, the audio signal processing device may project a microphone array signal into a spherical harmonics domain based on each base of spherical harmonics.

For example, the microphone array signal may be recorded through a spherical microphone array. When the center of the spherical coordinate system is matched to a center of the microphone array, a distance from the center of the microphone array to each microphone is constant. Therefore, the location of each microphone may be represented by an azimuth θ and an elevation angle ϕ. Provided that the location of qth microphone of the microphone array is ($\theta_q$, $\phi_q$), a signal $p_a$ recorded through the microphone may be represented as the following equation in the spherical harmonics domain.

$$p_a(\theta_q, \phi_q) = \sum_{m=0}^{\infty} \sum_{n=-m}^{m} B^{nm} Y^{nm}(\theta_q, \phi_q) \quad \text{[Equation 1]}$$

$p_a$ denotes a signal recorded through a microphone. ($\theta_q$, $\phi_q$) denotes the azimuth and the elevation angle of the qth microphone. Y denotes spherical harmonics having an azimuth and an elevation angle as factors. m denotes an order of the spherical harmonics, and n denotes a degree. B denotes an ambisonic coefficient corresponding to the spherical harmonics. In the present disclosure, the ambisonic coefficient may be referred to as an ambisonic signal. In detail, the ambisonic signal may represent either an FoA signal or an HoA signal.

Here, the audio signal processing device may obtain the ambisonic signal using a pseudo inverse matrix of spherical harmonics. In detail, the audio signal processing device may obtain the ambisonic signal using the following equation.

$$p_a = YB$$

$$\Leftrightarrow B = p\mathrm{inv}(Y)p_a \quad \text{[Equation 2]}$$

As described above, $p_a$ denotes a signal recorded through a microphone, and B denotes an ambisonic coefficient corresponding to spherical harmonics. pinv(Y) denotes a pseudo inverse matrix of Y.

The above-mentioned object signal represents an audio signal corresponding to a single sound object. In detail, the object signal may be a signal obtained by a sound collecting device near a specific sound object. Unlike an ambisonic signal that represents, in a space, all sounds collectable at a specific point, the object signal is used to represent that a sound output from a certain single sound object is delivered to a specific point. The audio signal processing device may represent the object signal in a format of an ambisonic signal using a location of a sound object corresponding to the object signal. Here, the audio signal processing device may measure the location of the sound object using an external sensor installed in a microphone which collects a sound corresponding to the sound object and an external sensor installed on a reference point for location measurement. In another specific embodiment, the audio signal processing device may analyze an audio signal collected by a microphone to estimate the location of the sound object by. In detail, the audio signal processing device may represent the object signal as an ambisonic signal using the following equation.

$$B_{nm}^{s} = SY(\theta_s, \phi_s) \quad \text{[Equation 3]}$$

θs and ϕs respectively denote an azimuth and an elevation angle representing the location of a sound object corresponding to an object. Y denotes spherical harmonics having an azimuth and an elevation angle as factors. $B^s nm$ denotes an ambisonic signal converted from an object signal.

Therefore, when the audio signal processing device simultaneously process an object signal and an ambisonic signal, the audio signal processing device may use at least one of the following methods. In detail, the audio signal processing device may separately output the object signal and the ambisonic signal. Furthermore, the audio signal processing device may convert the object signal into an ambisonic signal format to output the ambisonic signal and the object signal converted into the ambisonic signal format. Here, the ambisonic signal and the object signal converted into the ambisonic signal format may be HoA signals. Alternatively, the ambisonic signal and the object signal converted into the ambisonic signal format may be FoA signals. In another specific embodiment, the audio signal processing device may output only the ambisonic signal without the object signal. Here, the ambisonic signal may be FoA signals. Since it is assumed that the ambisonic signal includes all sounds collected from one point in a space, it may be assumed that the ambisonic signal includes signal components corresponding to the object signal. Therefore, the audio signal processing device may reproduce a sound object corresponding to the object signal by processing only the ambisonic signal without separately processing the object signal in the manner of the above-mentioned embodiment.

In a specific embodiment, the audio signal processing device may process the ambisonic signal and the object signal in the manner of the embodiment of FIG. 2. An ambisonic converter 31 converts an ambient sound into the ambisonic signal. A format converter 33 changes the formats of the object signal and the ambisonic signal. Here, the format converter 33 may convert the object signal into the ambisonic signal format. In detail, the format converter 33 may convert the object signal into HoA signals. Furthermore, the format converter 33 may convert the object signal into FoA signals. Furthermore, the format converter 33 may convert an HoA signal into an FoA signal. A post-processor 35 post-processes a format-converted audio signal. A binaural renderer 37 binaurally renders a post-processed audio signal. A post-processor 35 post-processes a format-converted audio signal. A renderer 37 renders a post-processed audio signal. Here, the renderer 37 may be a binaural renderer. Therefore, the renderer 37 may binaurally render a post-processed audio signal.

Figure 3:
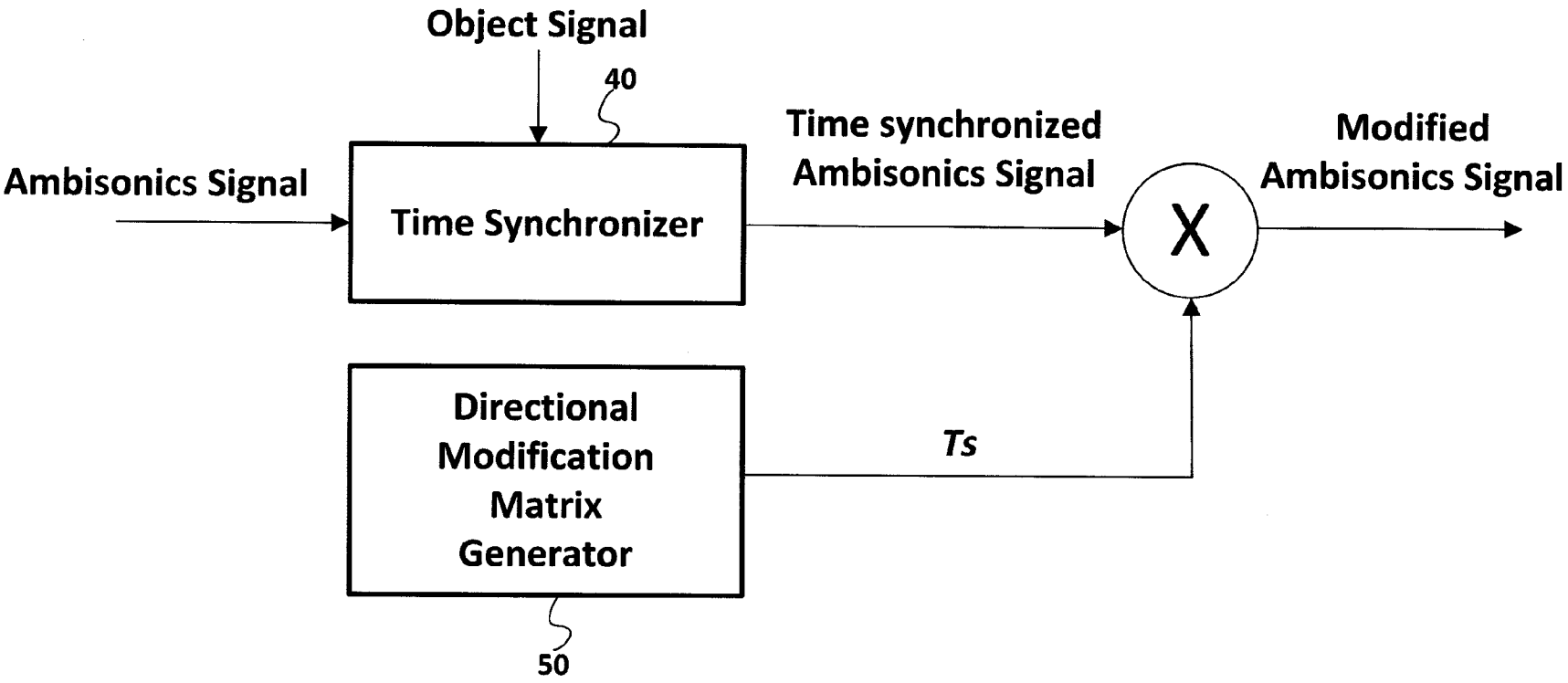
FIG. 3 is a block diagram illustrating operation of a renderer when an audio signal processing device according to an embodiment of the present invention concurrently processes an object signal and an ambisonic signal.

FIG. 3 is a block diagram illustrating operation of a renderer when the audio signal processing device according to an embodiment of the present invention concurrently processes an object signal and an ambisonic signal.

In the case in which the audio signal processing device concurrently processes an ambisonic signal and an object signal, a sense of immersion in a rendered sound may be deteriorated in comparison with the case in which the audio signal processing device individually processes an ambisonic signal and an object signal. This is because a direct sound in which an ambisonic signal obtained by converting an ambient sound and an object signal obtained by converting an object sound overlap each other may be output in the case in which the ambient sound and the object sound are concurrently collected. Therefore, in the case in which the audio signal processing device concurrently processes an ambisonic signal and an object signal, two sound images may be generated for the same object. Furthermore, when the ambient sound and the object sound are collected at different locations, the ambisonic signal obtained by converting the ambient sound and the object signal obtained by converting the object sound may not temporally synchronize with each other. Therefore, a rendering operation for preventing this phenomenon is required.

The audio signal processing device may temporally synchronize an object signal and an ambisonic signal. In detail, the audio signal processing device may temporally synchronize the object signal and the ambisonic signal by applying a delay to at least one of the object signal and the ambisonic signal. Furthermore, the audio signal processing device may temporally synchronize the object signal and the ambisonic signal based on a point of time at which a cross-correlation between the object signal and the ambisonic signal is maximized. In a specific embodiment, the audio signal processing device may apply a delay to at least one of the object signal and the ambisonic signal based on the point of time at which the cross-correlation between the object signal and the ambisonic signal is maximized. Furthermore, the audio signal processing device may obtain the time point at which the cross-correlation between the object signal and the ambisonic signal is maximized based on a correlation between a 0th order component of the ambisonic signal and the object signal. This is because the 0th order component of the ambisonic signal includes all of object sound components. In a specific embodiment, the audio signal processing device may obtain a normalized cross-correlation between the object signal and the ambisonic signal using the following equation.

$$NCF_n[d] = \frac{\sum_l s_o[l] b_w[l+d]}{\sqrt{\sum_l s_o^2[l] b_w^2[l]}} \quad \text{[Equation 4]}$$

Where $S_o[n]$ denotes an object signal, $b_w[n]$ denotes an ambisonic signal, and I denotes a sample number of an nth frame.

The audio signal processing device may obtain a delay value required for synchronization using the following equation.

$$TD[n] = \underset{d}{\operatorname{argmax}} |NCF_n[d]|_{d=-N}^{d=+N} \quad \text{[Equation 5]}$$

Where NCFn[d] denotes a normalized cross-correlation, and $$\underset{d}{\operatorname{argmax}}(x)$$

denotes d that maximizes x.

The audio signal processing device may modify the magnitude of a specific directional component of an ambisonic signal based on the location of an object simulated by an object signal. Here, the audio signal processing device may modify the magnitude of the specific directional component of the ambisonic signal without modifying an entire energy amount of the ambisonic signal. In detail, the audio signal processing device may apply, to the ambisonic signal, a matrix for modifying the magnitude of the specific directional component of the ambisonic signal. In a specific embodiment, the audio signal processing device may reduce a relative magnitude of a corresponding directional component of the ambisonic signal according to the location of the object simulated by the object signal. By this embodiment, the deterioration of the sense of immersion, which may occur when audio signal components corresponding to the objects are simultaneously rendered in the ambisonic signal and the object signal, may be prevented.

Here, the audio signal processing device may modify the magnitude of the specific directional component of the ambisonic signal based on location vector information indicating the location of the object signal. The location vector information may represent a location vector obtained when the object signal is converted into the ambisonic signal. In detail, the location vector may be obtained by decomposing a matrix indicating an HOA coefficient as expressed by the following equation.

$$H = USV^T = \sum_{i=1}^{(O+1)\hat{}2} us_i v_i^T = \sum_{i=1}^{N_f} us_i v_i^T + B.G., \quad \text{[Equation 6]}$$

where $N_f$<=(O+1)^2

H denotes an HOA coefficient. U denotes a unitary matrix, S denotes a non-negative diagonal matrix, and V denotes a unitary matrix. O denotes a highest order of a matrix H of HOA coefficients (i.e., ambisonic signal). $us_i$, which is a multiplication of a column vector of S and U, denotes an ith object signal, and $v_1$, which is a column vector of V, denotes information on the location of the ith object signal (i.e., spatial characteristic).

Furthermore, the audio signal processing device may modify the magnitude of a specific directional component of an ambisonic signal based on the location of a visual object matched to an object corresponding to an object signal. Here, the location of the visual object represents the location in a virtual space simulated by the object signal. For convenience, the visual object matched to the object corresponding to the object signal is referred to as a matching visual object. The matching visual object may be extracted from a video signal which is played concurrently with an audio signal. Here, the audio signal processing device may determine, as the matching visual object, the visual object which varies with a change of the object corresponding to the object signal. In detail, the audio signal processing device may determine, as the matching visual object, the visual object, the location of which varies with a change of the object corresponding to the object signal. In a specific embodiment, the audio signal processing device may determine, as the matching visual object, the visual object, the location of which varies with a location change of the object corresponding to the object signal. In another specific embodiment, the audio signal processing device may determine, as the matching visual object, the visual object, the visual feature of which varies with a sound feature change of the object corresponding to the object signal. Here, the sound feature may include at least one of a strength of audio signal or a frequency band energy distribution of an audio signal. The visual feature may include at least one of a size of the visual object, a shape of the visual object, or a color of the visual object. For example, the audio signal processing device may determine the visual object as the matching visual object, wherein the distance between the visual object and a reference location varies with a change of the audio object. For example, the audio signal processing device may determine the visual object as the matching visual object, wherein the distance between the visual object and the reference location varies with a sound strength change of the audio object. In a specific embodiment, the audio signal processing device may determine one of a plurality of visual objects as the matching visual object. Furthermore, when there are a plurality of objects corresponding to the object signal, the audio signal processing device may modify the magnitude of a specific directional component of the ambisonic signal based on the location of an object having the matching visual object of a highest similarity.

In the embodiment of FIG. 3, the renderer 37 includes a time synchronizer 40 and a directional modification matrix generator 50. The time synchronizer 40 temporally synchronizes an ambisonic signal with an object signal to generate a time synchronized ambisonic signal which is temporally synchronized with the object signal. The directional modification matrix generator 50 generates a directional modification matrix Ts for modifying the magnitude of a specific directional component of an ambisonic signal. The renderer 37 applies the directional modification matrix Ts to the time synchronized ambisonic signal. By these embodiments, the audio signal processing device may prevent the deterioration of the sense of immersion, which may occur when an ambisonic signal and an object signal are rendered concurrently.

Figure 4:
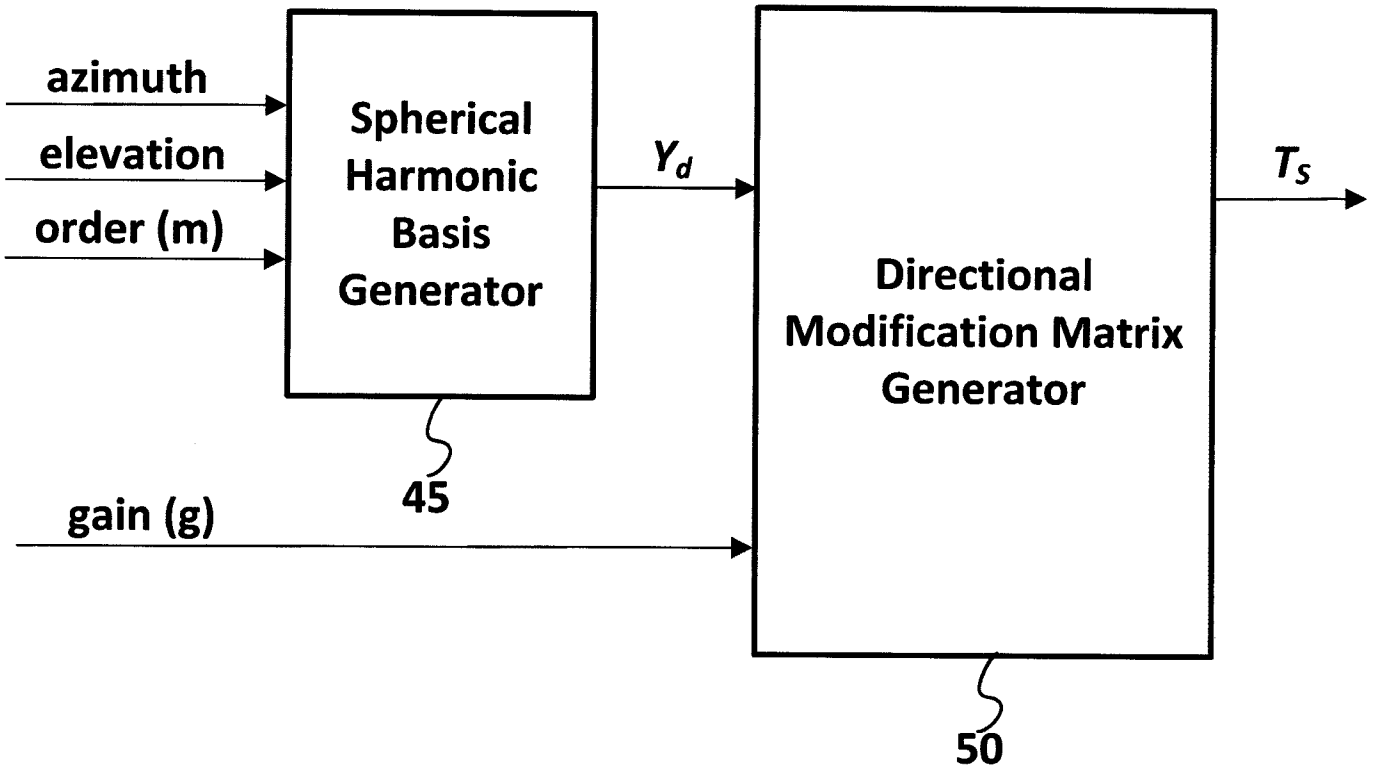
FIG. 4 is a block diagram illustrating a directional modification matrix generator according to an embodiment of the present invention.

FIG. 4 is a block diagram illustrating a directional modification matrix generator according to an embodiment of the present invention.

The audio signal processing device may apply the directional modification matrix to a basis of spherical harmonics. In detail, the audio signal processing device may apply the directional modification matrix to an ambisonic signal using the following equation.

$$T_s = I + \frac{g}{m+I} Y_d Y_d^T \quad \text{[Equation 7]}$$

$T_s$ denotes a directional modification matrix. Yd denotes a basis of spherical harmonics determined by an azimuth θ and an elevation ϕ, and I denotes an identity matrix. m denotes an order of an ambisonic signal, and indicates a direction to modify with. g denotes a magnitude to modify with.

In the embodiment of FIG. 4, a spherical harmonic basis generator 45 generates a basis $Y_d$ of spherical harmonics according to an azimuth, an elevation, and an order. The directional modification matrix generator 50 generates the directional modification matrix $T_s$ by applying Equation 7 to the basis $Y_d$ of spherical harmonics.

In the case in which the audio signal processing device individually processes the directional modification matrix and another matrix for transforming an ambisonic signal, an operation amount of the audio signal processing device may increase. Therefore, the audio signal processing device may serially process the directional modification matrix and the other matrix for transforming an ambisonic signal. Here, the other matrix for transforming an ambisonic signal may be a matrix for controlling at least one of yaw, pitch, or roll to move the location of a sound image simulated by the ambisonic signal. Here, the movement of the location of the sound image may be performed to match the sound image simulated by the ambisonic signal to a space simulated by a video signal. Furthermore, the movement of the location of the sound image may be performed to move the location of the sound image according to a movement of the user. In detail, the audio signal processing device may generate an integrated matrix by multiplying the directional modification matrix by the other matrix for transforming an ambisonic signal, and may apply the integrated matrix to an ambisonic signal.

In the case in which the audio signal processing device modifies the magnitude of a specific directional component of an ambisonic signal, signal components other than the specific directional component may also be modified due to a width of a spherical harmonics beam pattern of the ambisonic signal. Therefore, a frequency characteristic of the ambisonic signal may change. The audio signal processing device may compensate, by using an equalizer, the ambisonic signal having the magnitude-modified specific directional component. In detail, the audio signal processing device may compensate the ambisonic signal having the magnitude-modified specific directional component, using the equalizer generated based on a frequency response pattern of the ambisonic signal before the modification of the magnitude of the specific directional component. Here, the equalizer may be generated based on a frequency magnitude response of the ambisonic signal before the modification of the magnitude of the specific directional component.

Throughout the above-mentioned embodiments, a method for obtaining, by the audio signal processing device, information on the location of an object signal based on a visual object has been described. In the case in which the sound collecting device includes a visual pattern specified in advance, the audio signal processing device may treat the visual pattern as a type of a visual object. In detail, the audio signal processing device may extract a pre-specified visual pattern from a video signal in which an image of the sound collecting device is captured, and may obtain the information on the location of the sound collecting device based on a feature of the extracted visual pattern. This operation will be described with reference to FIG. 5.

Figure 5:
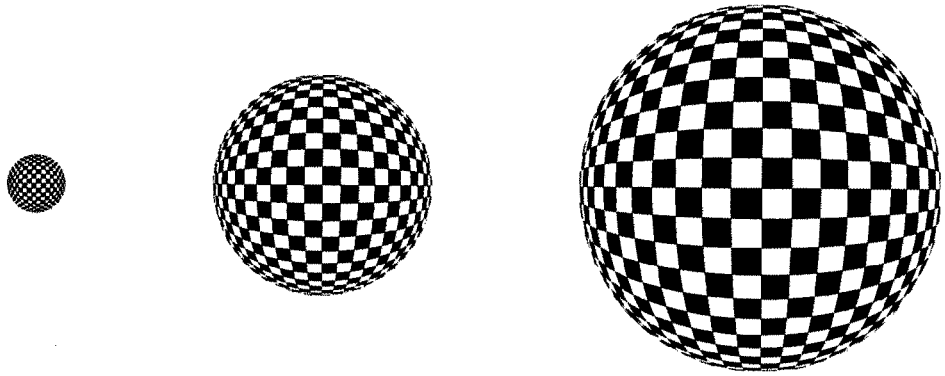
FIG. 5 illustrates a visual pattern included in a sound collecting device according to an embodiment of the present invention.

FIG. 5 illustrates a visual pattern included in the sound collecting device according to an embodiment of the present invention.

The information on the location of the sound collecting device may include an azimuth of the sound collecting device from a reference point. In detail, the audio signal processing device may obtain the azimuth of the sound collecting device from the reference point based on a curvature of an extracted visual pattern. In a specific embodiment, the audio signal processing device may estimate the azimuth of the sound collecting device from the reference point by comparing a visual pattern at the reference point with the visual pattern extracted from a video signal in terms of degree of distortion. For example, when the degree of distortion of the visual pattern extracted from the video signal at a second time point is lower than the degree of distortion of the visual pattern extracted from the video signal at a first time point, the audio signal processing device may determine that the azimuth of the sound collecting device is larger at the second time point than at the first time point. Furthermore, when the degree of distortion of the visual pattern extracted from the video signal at the second time point is higher than the degree of distortion of the visual pattern extracted from the video signal at the first time point, the audio signal processing device may determine that the azimuth of the sound collecting device is smaller at the second time point than at the first time point.

Furthermore, the information on the location of the sound collecting device may include a distance from the reference point to the sound collecting device. In detail, the audio signal processing device may estimate the distance from the reference point to the sound collecting device based on the size of a visual pattern. For example, when the size of the visual pattern extracted from the video signal is smaller than the size of an initially specified visual pattern, the audio signal processing device may determine that the sound collecting device is farther away from the reference point than a distance corresponding to the initially specified visual pattern. Furthermore, when the size of the visual pattern extracted from the video signal is larger than the size of the initially specified visual pattern, the audio signal processing device may determine that the sound collecting device is closer from the reference point than the distance corresponding to the initially specified visual pattern.

In the embodiment of FIG. 5, the middle visual pattern represents the size of the initially specified visual pattern. When the size of the visual pattern extracted by the audio signal processing device from the video signal is the same as that of the left visual pattern of FIG. 5, the audio signal processing device may determine that the sound collecting device is closer from the reference point than the distance corresponding to the initially specified visual pattern. When the size of the visual pattern extracted by the audio signal processing device from the video signal is the same as that of the right visual pattern of FIG. 5, the audio signal processing device may determine that the sound collecting device is farther away from the reference point than the distance corresponding to the initially specified visual pattern.

In the above-mentioned embodiment, the reference point may represent the location of a camera that has captured an image of the sound collecting device. The audio signal processing device may adjust the location of a sound image of an audio signal using the information on the location of the sound collecting device collected through the above-mentioned embodiments. Furthermore, the audio signal processing device may modify the magnitude of a specific directional component of an audio ambisonic signal using the information on the location of the sound collecting device collected through the above-mentioned embodiments.

In the case in which the audio signal processing device concurrently processes an object signal and an ambisonic signal, the audio signal processing device may convert the object signal into an ambisonic signal to render the object signal as described above. When rendering the ambisonic signal, the ambisonic signal is rendered into a scene-based audio. When the audio signal processing device renders the scene-based audio signal, the audio signal processing device may simulate a relative position change between a listener and a sound image within 3 degrees of freedom (3DOF) such as yaw, pitch, and roll based on the head of the user in response to the movement of the user. However, when the audio signal processing device renders the scene-based audio signal, it may be difficult for the audio signal processing device to simulate the relative position change between the listener and the sound image due to signal characteristics of an ambisonic signal. In detail, when the user horizontally moves in a virtual space simulated by an audio signal, it may be difficult for the audio signal processing device to simulate the relative position change of the sound image caused by the horizontal movement of the user.

Therefore, the audio signal processing device requires a method for simulating the relative position change of the sound image within 6DOF when rendering an ambisonic signal. Relevant descriptions will be provided with reference to FIGS. 6 to 9.

Figure 6:
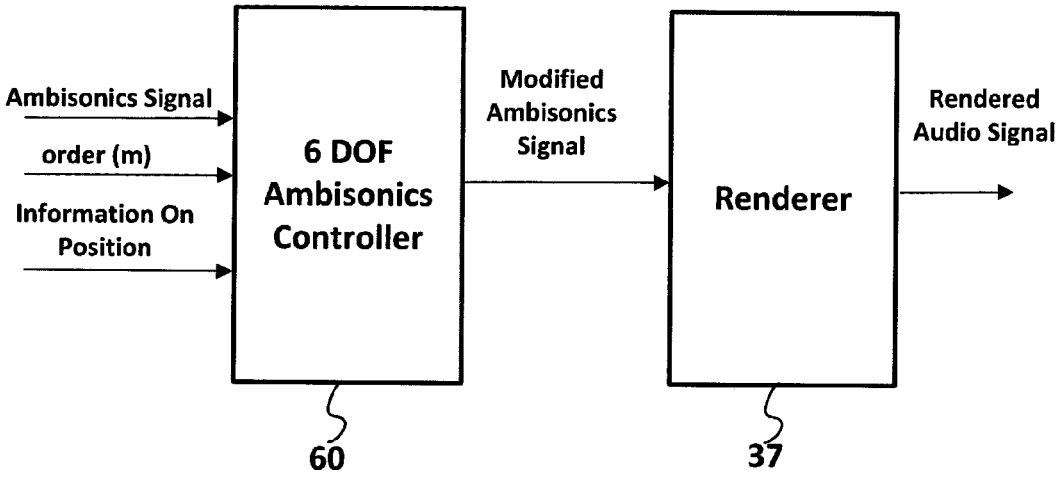
FIG. 6 is a block diagram illustrating an operation of simulating, within 6DOF, a relative position change between a listener and a sound image represented by an ambisonic signal in the audio signal processing device according to an embodiment of the present invention.

FIG. 6 is a block diagram illustrating an operation of simulating, within 6DOF, a relative position change between a listener and a sound image represented by an ambisonic signal in the audio signal processing device according to an embodiment of the present invention.

The audio signal processing device collects information on location, and simulates the relative position change of the sound image represented by the ambisonic signal within 6DOF based on the information on location. Here, the location information may represent information indicating the location of the listener in the virtual space simulated by the ambisonic signal. The location information may include information indicating a movement of the user. In detail, the information indicating the movement of the user may include at least one of information indicating head rotation of the user or information indicating a spatial movement of the user.

In detail, the audio signal processing device may modify the magnitude of a specific directional component of the ambisonic signal according to a movement direction of the listener in the virtual space simulated by the ambisonic signal. Here, the audio signal processing device may modify the magnitude of the specific directional component of the ambisonic signal without modifying an entire energy amount of the ambisonic signal. In a specific embodiment, the audio signal processing device may modify the magnitude of an ambisonic signal component corresponding to the movement direction of the listener in the virtual space simulated by the ambisonic signal. For example, the audio signal processing device may amplify the magnitude of an ambisonic signal component corresponding to a sound image in the movement direction of the listener in the virtual space simulated by the ambisonic signal. Furthermore, the audio signal processing device may reduce the magnitude of an ambisonic signal component corresponding to a sound image opposite to the movement direction of the listener in the virtual space simulated by the ambisonic signal.

In the embodiment of FIG. 6, a 6DOF controller 60 receives an ambisonic signal, information on an order of the ambisonic signal, and information on the location of the ambisonic signal, and outputs a modified ambisonic signal according to the information on the location. Here, the 6DOF controller 60 may apply a directional modification matrix for modifying the magnitude of a specific directional component of the ambisonic signal according to the information on the location. In another specific embodiment, the 6DOF controller 60 may convert the ambisonic signal into a channel signal to output the modified ambisonic signal according to the information on the location. Here, the audio signal processing device may modify a specific channel signal according to a relative position change between the listener and a plurality of virtual speakers corresponding to channel signals.

The renderer 37 renders the modified ambisonic signal. In detail, the renderer 37 may binaurally render the modified ambisonic signal according to characteristics of the modified ambisonic signal. In a specific embodiment, the renderer 37 may binaurally render the modified ambisonic signal based on ambisonics. In the case in which an ambisonic signal is converted into a channel signal, the renderer 37 may binaurally render the modified ambisonic signal based on a channel.

Figure 7:
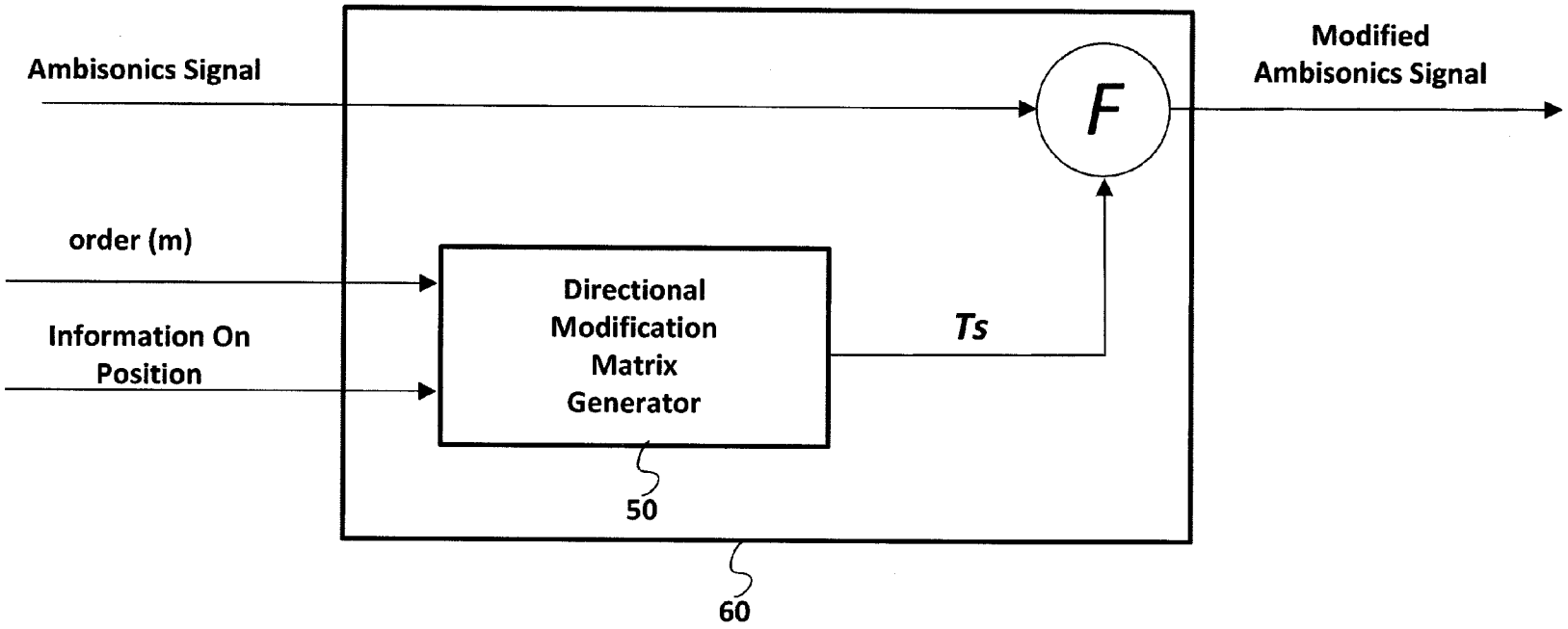
FIG. 7 is a block diagram illustrating an operation of modifying the magnitude of a specific directional component of an ambisonic signal based on information on location in the audio signal processing device according to an embodiment of the present invention.

FIG. 7 is a block diagram illustrating an operation of modifying the magnitude of a specific directional component of an ambisonic signal based on information on location in the audio signal processing device according to an embodiment of the present invention.

The 6DOF controller 60 may include the directional modification matrix generator 50 described above with reference to FIG. 4. In detail, the directional modification matrix generator 50 may generate the directional modification matrix based on the order of an ambisonic signal and the information on location. As described above, the information on location may include information indicating the movement of the user. In detail, the information indicating the movement of the user may include at least one of information indicating head rotation of the user or information indicating a spatial movement of the user. Furthermore, the directional modification matrix generator 50 may generate the directional modification matrix according to Equation 7 described above. The 6DOF controller 60 generates the modified ambisonic signal by applying the directional modification matrix to the ambisonic signal. In detail, the 6DOF controller 60 may generate the modified ambisonic signal by multiplying the ambisonic signal by directional modification matrix.

Here, as described above with reference to FIG. 4, the audio signal processing device may compensate the ambisonic signal having a magnitude-modified specific directional component, using the equalizer generated based on a frequency response pattern of the ambisonic signal. In this manner, signal characteristics of the ambisonic signal may be prevented from being distorted.

Figure 8:
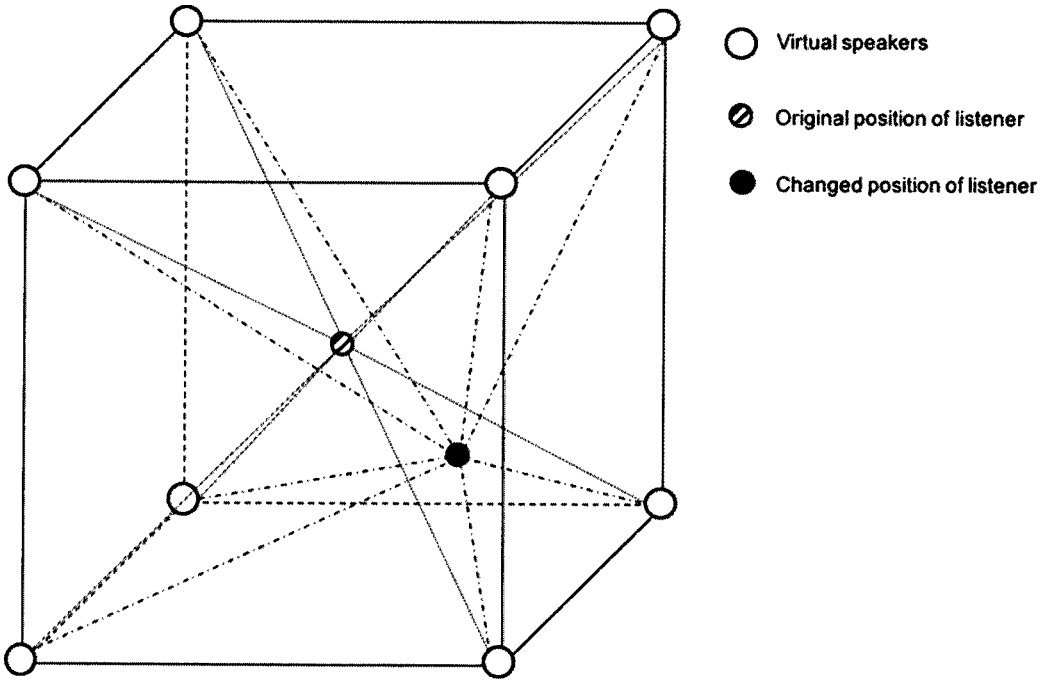
FIG. 8 illustrates that the audio signal processing device according to an embodiment of the present invention models an ambisonic signal into a sound to be output by a plurality of virtual speakers.

FIG. 8 illustrates that the audio signal processing device according to an embodiment of the present invention models an ambisonic signal into a sound to be output by a plurality of virtual speakers.

As described above, the audio signal processing device may convert an ambisonic signal into a channel signal to render the ambisonic signal. Here, the audio signal processing device may modify the magnitude of a specific component of the channel signal according to a change of a relative position between a speaker modeled by the channel signal and the listener in a virtual space simulated by the ambisonic signal. For example, in the embodiment of FIG. 8, eight speakers are arranged in the virtual space, and the relative position between the listener and the eight speakers changes as the user moves from an original location to a changed location. Here, the audio signal processing device may modify, according to the change of the relative position between the listener and the eight speakers, the magnitude of a specific directional component of the ambisonic signal converted into the channel signal to render the ambisonic signal.

In detail, the audio signal processing device may change a sound output direction according to the relative position change of the speaker. Furthermore, the audio signal processing device may reflect at least one of a near field effect, speaker directivity, or a Doppler effect according to the relative position change of the speaker to render the signal obtained by converting the ambisonic signal into the channel signal. A specific operation for processing an audio signal will be described with reference to FIG. 9.

Figure 9:
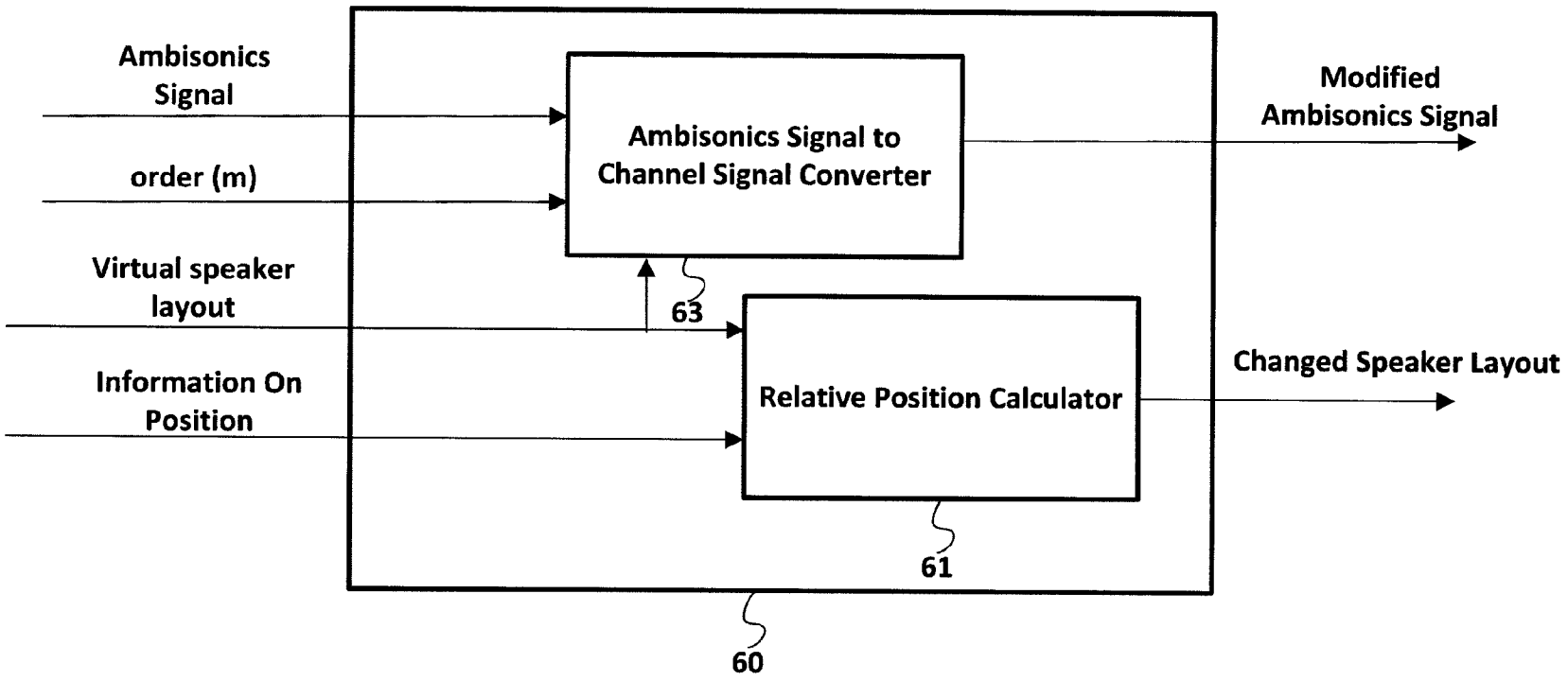
FIG. 9 is a block diagram illustrating an operation of modifying the magnitude of a specific directional component of an ambisonic signal by converting the ambisonic signal into a channel signal based on information on location in the audio signal processing device according to an embodiment of the present invention.

FIG. 9 is a block diagram illustrating an operation of modifying the magnitude of a specific directional component of an ambisonic signal by converting the ambisonic signal into a channel signal based on information on location in the audio signal processing device according to an embodiment of the present invention.

The 6DOF controller 60 includes a relative position calculator 63 and a converter 63 for converting an ambisonic signal into a channel signal. The relative position calculator 61 calculates the relative position between the listener and a plurality of virtual speakers modeled by the channel signal. In detail, the relative position calculator 61 may calculate the relative position between the listener and the plurality of virtual speakers modeled by the channel signal, based on the information on location and information on the locations of the plurality of virtual speakers modeled by the channel signal. Here, as described above, the information on location may represent information indicating the location of the listener in the virtual space simulated by the ambisonic signal. The locations of the plurality of virtual speakers may be referred to as a layout of the virtual speakers.

The converters 63 converts the ambisonic signal into the channel signal. In detail, the converters 63 converts the ambisonic signal into the channel signal based on the information on the locations of the plurality of virtual speakers modeled by the channel signal.

Even when the user horizontally moves in a virtual space simulated by an audio signal, the audio signal processing device may efficiently simulate a relative position change of a sound image caused by the horizontal movement of the user, by the embodiments described above with reference to FIGS. 6 to 9.

Figure 10:
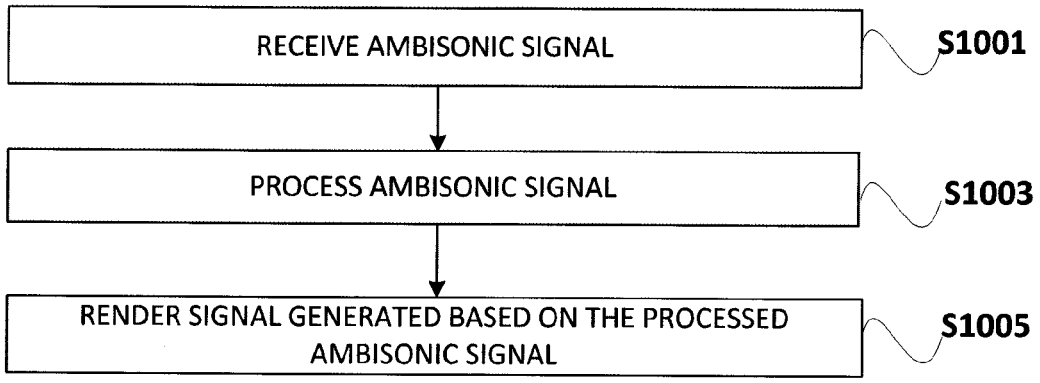
FIG. 10 is a flowchart illustrating operation of the audio signal processing device according to an embodiment of the present invention.

FIG. 10 is a flowchart illustrating operation of the audio signal processing device according to an embodiment of the present invention.

The audio signal processing device receives an ambisonic signal (S1001). The audio signal processing device may concurrently receive the ambisonic signal and an object signal. Here, the ambisonic signal and the object signal may be signals obtained by converting a sound collected by the sound collecting device. The sound collecting device may be a microphone. The sound collecting device may be a microphone array including a plurality of microphones. Here, the ambisonic signal and the object signal may be signals obtained by converting an ambient sound and an object sound collected in the same space. In detail, the ambisonic signal and the object signal may be signals obtained by converting an ambient sound and an object sound collected simultaneously in the same space.

The audio signal processing device processes the ambisonic signal (S1003). The audio signal processing device may process the ambisonic signal based on information on a location. In detail, the audio signal processing device may modify the magnitude of a specific directional component of the ambisonic signal based on the location of an object simulated by the object signal. Here, the audio signal processing device may modify the magnitude of the specific directional component of the ambisonic signal without modifying an entire energy amount of the ambisonic signal. In detail, the audio signal processing device may modify the magnitude of the specific directional component of the ambisonic signal based on a location vector generated when converting the object signal into an ambisonic signal format. Furthermore, the audio signal processing device may modify the magnitude of the specific directional component of the ambisonic signal based on the location of a matching visual object matched to an object corresponding to the object signal. An audio signal processed by the audio signal processing device may be played together with a video signal. Here, the audio signal processing device may determine, as the matching visual object, a visual object, the location of which varies with a change of the object corresponding to the object signal. Furthermore, the audio signal processing device may determine, as the matching visual object, a visual object, the location of which varies with a change of the object corresponding to the object signal. Moreover, the audio signal processing device may determine, as the matching visual object, a visual object, the visual feature of which varies with a change of a sound feature of the object corresponding to the object signal. In detail, the audio signal processing device may process the ambisonic signal based on the object signal as described above with reference to FIGS. 3 and 4. Furthermore, the audio signal processing device may obtain information on the location of the sound collecting device which collects audio signals, as described above with reference to FIG. 5. The audio signal processing device may process the object signal and the ambisonic signal based on the obtained location information. Here, the audio signal processing device may compensate the ambisonic signal having a magnitude-modified specific directional component, using the equalizer generated based on a frequency response pattern of the ambisonic signal. In detail, the equalizer may be generated based on a frequency magnitude response pattern of the ambisonic signal. In this manner, the audio signal processing device may prevent signal distortion caused by a modification of the magnitude of the specific directional component.

Furthermore, the audio signal processing device may temporally synchronize the ambisonic signal and the object signal. In detail, the audio signal processing device may apply a delay to at least one of the ambisonic signal or the object signal. Furthermore, the audio signal processing device may temporally synchronize the ambisonic signal with the object signal based on a time point at which the cross-correlation between the ambisonic signal and the object signal is maximized. In a specific embodiment, the audio signal processing device may temporally synchronize the ambisonic signal with the object signal based on a time point at which the cross-correlation between the 0th order component of the ambisonic signal and the object signal is maximized.

In another specific embodiment, the audio signal processing device may receive information indicating the location of the listener in the virtual space simulated by the ambisonic signal, and may simulate a relative position change of a sound image represented by the ambisonic signal within 6DOF based on the location of the listener. In detail, the audio signal processing device may modify the magnitude of a specific directional component of the ambisonic signal according to a movement direction of the listener in the virtual space simulated by the ambisonic signal. Here, the audio signal processing device may modify the magnitude of the specific directional component of the ambisonic signal without modifying an entire energy amount of the ambisonic signal. In a specific embodiment, the audio signal processing device may modify the magnitude of an ambisonic signal component corresponding to the movement direction of the listener in the virtual space simulated by the ambisonic signal. For example, the audio signal processing device may amplify the magnitude of an ambisonic signal component corresponding to a sound image in the movement direction of the listener in the virtual space simulated by the ambisonic signal. Furthermore, the audio signal processing device may reduce the magnitude of an ambisonic signal component corresponding to a sound image opposite to the movement direction of the listener in the virtual space simulated by the ambisonic signal. In a specific embodiment, as described above with reference to FIG. 7, the audio signal processing device may apply the directional modification matrix to the ambisonic signal to simulate the relative position change of the sound image represented by the ambisonic signal. Furthermore, as described above with reference to FIGS. 8 and 9, the audio signal processing device may convert the ambisonic signal into a channel signal to simulate the relative position change of the sound image represented by the ambisonic signal.

The audio signal processing device renders a signal generated based on a processed ambisonic signal (S1005). As described above with reference to FIGS. 1 and 2, the audio signal processing device may convert the object signal into an ambisonic signal format, and then may concurrently render the converted object signal and the ambisonic signal. Furthermore, the audio signal processing device may convert the ambisonic signal into a channel signal to render the ambisonic signal as described above with reference to FIG. 6.

In this manner, the audio signal processing device may prevent the deterioration of the sense of immersion, which may occur when an ambisonic signal and an object signal are rendered concurrently. Furthermore, the audio signal processing device may efficiently simulate a change of a relative position between a sound image and a listener in a virtual space simulated by the ambisonic signal. FIG. 3 is a block diagram illustrating operation of a renderer when the audio signal processing device according to an embodiment of the present invention concurrently processes an object signal and an ambisonic signal.

Embodiments of the present invention provide an audio signal processing method and device for processing a plurality of audio signals.

More specifically, embodiments of the present invention provide an audio signal processing method and device for processing an audio signal expressible as an ambisonic signal.

Although the present invention has been described using the specific embodiments, those skilled in the art could make changes and modifications without departing from the spirit and the scope of the present invention. That is, although the embodiments for processing multi-audio signals have been described, the present invention can be equally applied and extended to various multimedia signals including not only audio signals but also video signals. Therefore, any derivatives that could be easily inferred by those skilled in the art from the detailed description and the embodiments of the present invention should be construed as falling within the scope of right of the present invention.

What is claimed is:

1. An audio signal processing device comprising:

a receiving unit configured to receive an ambisonic signal and an object signal;

a processor configured to modify a magnitude of a specific directional component of the ambisonic signal based on a location of an object simulated by the object signal, temporally synchronize the ambisonic signal with the object signal based on a time point at which a cross-correlation between a 0th order component of the ambisonic signal and the object signal is maximized, and render a signal generated based on the object signal and the ambisonic signal having a magnitude-modified specific directional component; and an output unit configured to output the rendered signal, wherein the ambisonic signal simulates an ambient sound of a virtual space where an object sound simulated by the object signal is positioned.

2. The audio signal processing device of claim 1, wherein the object signal and the ambisonic signal are signals respectively obtained by converting an object sound and an ambient sound collected in the same space.

3. The audio signal processing device of claim 1, wherein the processor modifies the magnitude of the specific directional component of the ambisonic signal based on a location vector generated when converting the object signal into an ambisonic signal format.

4. The audio signal processing device of claim 1, wherein the processor modifies the magnitude of the specific directional component of the ambisonic signal based on a location of a matching visual object matched to an object corresponding to the object signal.

5. The audio signal processing device of claim 4, wherein the processor determines, as the matching visual object, a visual object, a location of which varies with a change of the object corresponding to the object signal.

6. The audio signal processing device of claim 4, wherein the processor determines, as the matching visual object, a visual object, a visual feature of which varies with a change of a sound feature of the object corresponding to the object signal.

7. The audio signal processing device of claim 1, wherein the processor compensates the ambisonic signal having the magnitude-modified specific directional component by using an equalizer generated based on a frequency characteristic of the ambisonic signal.

8. The audio signal processing device of claim 1, wherein the processor reduces the magnitude of the specific directional component of the ambisonic signal based on the location of the object simulated by the object signal.

9. The audio signal processing device of claim 1, wherein the processor temporally synchronizes the ambisonic signal with the object signal by applying a delay to at least one of the ambisonic signal or the object signal.

10. A method for operating an audio signal processing device, the method comprising:

receiving an ambisonic signal and an object signal;

modifying a magnitude of a specific directional component of the ambisonic signal based on a location of an object simulated by the object signal;

temporally synchronizing the ambisonic signal with the object signal based on a time point at which a cross-correlation between a 0th order component of the ambisonic signal and the object signal is maximized; and rendering a signal generated based on the object signal and the ambisonic signal having a magnitude-modified specific directional component, wherein the ambisonic signal simulates an ambient sound of a virtual space where an object sound simulated by the object signal is positioned.

11. The method of claim 10, wherein the object signal and the ambisonic signal are signals respectively obtained by converting an object sound and an ambient sound collected in the same space.

12. The method of claim 10, wherein the modifying the magnitude of the specific directional component of the ambisonic signal comprises modifying the magnitude of the specific directional component of the ambisonic signal based on a location vector generated when converting the object signal into an ambisonic signal format.

13. The method of claim 10, wherein the modifying the magnitude of the specific directional component of the ambisonic signal comprises modifying the magnitude of the specific directional component of the ambisonic signal based on a location of a matching visual object matched to an object corresponding to the object signal.

14. The method of claim 13, wherein the modifying the magnitude of the specific directional component of the ambisonic signal based on the location of the matching visual object comprises determining, as the matching visual object, a visual object, a location of which varies with a change of the object corresponding to the object signal.

15. The method of claim 12, wherein the modifying the magnitude of the specific directional component of the ambisonic signal based on the location of the matching visual object comprises determining, as the matching visual object, a visual object, a visual feature of which varies with a change of a sound feature of the object corresponding to the object signal.

16. The method of claim 10, wherein the modifying the magnitude of the specific directional component of the ambisonic signal comprises compensating the ambisonic signal having the magnitude-modified specific directional component by using an equalizer generated based on a frequency response pattern of the ambisonic signal.

17. The method of claim 10, wherein the modifying the magnitude of the specific directional component of the ambisonic signal comprises reducing the magnitude of the specific directional component of the ambisonic signal based on the location of the object simulated by the object signal.

* * * * *